US007699111B2

(12) United States Patent
Brooks et al.

(10) Patent No.: US 7,699,111 B2
(45) Date of Patent: Apr. 20, 2010

(54) FLOAT COLLAR AND METHOD

(75) Inventors: Robert T. Brooks, Houston, TX (US); Frank V. De Lucia, Houston, TX (US)

(73) Assignee: TAM International, Inc., Houston, TX (US)

( * ) Notice: Subject to any disclaimer, the term of this patent is extended or adjusted under 35 U.S.C. 154(b) by 95 days.

(21) Appl. No.: 12/011,690

(22) Filed: Jan. 29, 2008

(65) Prior Publication Data

US 2009/0188678 A1 Jul. 30, 2009

(51) Int. Cl.
*E21B 33/12* (2006.01)

(52) U.S. Cl. ..... 166/373; 166/192

(58) Field of Classification Search ..... 166/373, 166/386, 192

See application file for complete search history.

(56) References Cited

U.S. PATENT DOCUMENTS

| | | | | |
|---|---|---|---|---|
| 2,295,803 | A * | 9/1942 | O'Leary | 175/318 |
| 2,814,947 | A | 12/1957 | Stegemeier et al. | |
| 2,945,541 | A | 7/1960 | Maly et al. | |
| 4,137,970 | A | 2/1979 | Laflin et al. | |
| 4,520,227 | A | 5/1985 | Krimmer et al. | |
| 4,633,950 | A | 1/1987 | Delhommer et al. | |
| 6,173,457 | B1 | 1/2001 | Higgins | |
| 6,199,221 | B1 | 3/2001 | Stahlhut | |
| 6,311,775 | B1 | 11/2001 | Allamon et al. | |
| 6,334,487 | B1 | 1/2002 | Adkins et al. | |
| 6,390,200 | B1 | 5/2002 | Allamon et al. | |
| 6,401,824 | B1 | 6/2002 | Musselwhite et al. | |
| 6,467,546 | B2 | 10/2002 | Allamon et al. | |
| 6,491,103 | B2 | 12/2002 | Allamon et al. | |
| 6,497,291 | B1 | 12/2002 | Szarka | |
| 6,513,598 | B2 | 2/2003 | Moore et al. | |
| 6,679,336 | B2 | 1/2004 | Musselwhite et al. | |
| 6,684,957 | B2 | 2/2004 | Allamon | |
| 6,712,145 | B2 | 3/2004 | Allamon | |
| 6,772,841 | B2 | 8/2004 | Gano | |
| 6,802,374 | B2 | 10/2004 | Edgar et al. | |
| 6,962,163 | B1 | 11/2005 | Edwards | |
| 7,029,274 | B1 | 4/2006 | Capps | |
| 7,101,176 | B1 | 9/2006 | Capps | |
| 7,234,522 | B2 | 6/2007 | Johnson et al. | |
| 2005/0199401 | A1 | 9/2005 | Patel et al. | |

FOREIGN PATENT DOCUMENTS

| | | |
|---|---|---|
| WO | WO 02-020941 | 3/2002 |

* cited by examiner

*Primary Examiner*—Shane Bomar
(74) *Attorney, Agent, or Firm*—Browning Bushman P.C.

(57) ABSTRACT

A float collar 10 includes a housing 12 and a generally sleeve-shaped elastomer 20. The lower plate 30 and an upper plate 32 are each supported on an elongate rod 22, and at least one of the plates is axially fixed relative to the tubular housing. The plate intended for exposure to fluid pressure includes a plurality of arcuate flow ports 34 for communication with the annulus between the tubular housing and the elastomer prior to swelling of the elastomer.

21 Claims, 2 Drawing Sheets

FLOAT COLLAR AND METHOD

FIELD OF THE INVENTION

The present invention relates to float shoes and float collars used downhole by oil and gas exploration companies to control the flow of fluid, typically cement, from the lower end of a tubular string. More particularly, this invention relates to a swellable float shoe or collar that seals the flow port through the tool by swelling of an elastomeric body in response to downhole fluids.

BACKGROUND OF THE INVENTION

Numerous types of float shoes and float collars have been devised. A float shoe is a type of downhole valve that is used at the lower end of a tubular string and is conventionally adapted to be a float collar and to support another tool or a length of tubular below the collar. The float shoe is functionally similar to a float collar, but conventionally has a rounded lower end with no equipment beneath the shoe. Many float shoes include one or more poppet valves that are controlled by fluid pressure to open and close off a flow of fluid through the tool.

The following U.S. patents relate generally to float shoes and collars: U.S. Pat. Nos. 6,173,457, 6,199,221, 6,311,775, 6,334,487, 6,390,200, 6,401,824, 6,467,546, 6,491,103, 6,497,291, 6,513,598, 6,679,336, 6,684,957, 6,712,145, 6,772,841, 6,802,374, 6,962,163, 7,029,274, 7,101,176, 7,234,522. Swellable packers are disclosed in U.S. Pat. Nos. 2,814,947, 2,945,541, 4,137,970, 4,520,227 and 4,633,950, and Publications 2005/0199401 and WO 02/20941.

The disadvantages of the prior art are overcome by the present invention and an improved float shoe and float collar are hereinafter disclosed which use a swellable elastomer to reliably close off the flow port through the tool.

SUMMARY OF THE INVENTION

In one embodiment, a float collar is provided for controlling the flow of fluidic materials from a lower end of a tubular string in a well. The float collar includes a housing and a generally sleeve-shaped elastomer positioned about an elongate rod radially within the elastomer. A lower plate at a lower end of the elastomer and upper plate at an upper end of elastomer are provided, with each plate supported on the elongate rod. At least one of the lower plate and the upper plate is axially fixed relative to the tubular housing. One of the lower plate and the upper plate intended for exposure to fluid pressure has a plurality of arcuate flow ports for fluid communication with an annulus between the housing and the sleeve-shaped elastomer. The flow ports are axially adjacent the elastomer to substantially fill the one or more ports when the elastomer swells to engage a tubular housing, thereby reducing the cross-sectional area of the elastomer exposed to fluid pressure.

In one embodiment, a method of the invention involves positioning the lower plate and the upper plate as disclosed above, and subjecting the elastomer to a downhole fluid such that the elastomer swells to substantially fill the one or more ports.

These and further features and advantages of the present invention will become apparent from the following detailed description, wherein reference is made to the figures in the accompanying drawings.

DETAILED DESCRIPTION OF PREFERRED EMBODIMENTS

Figure 1:
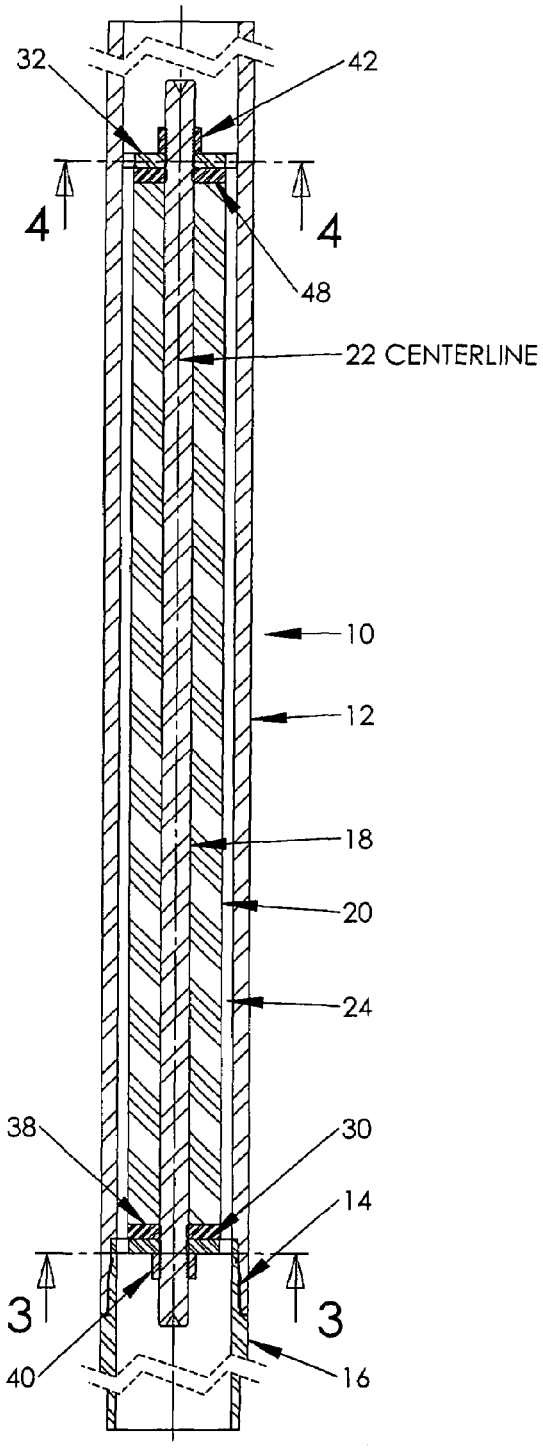
FIG. 1 is a cross-sectional view of a suitable float collar prior to swelling of the elastomer.

FIG. 1 illustrates in cross-section a suitable float collar according to the present invention. The lower end of the float collar 10 as shown in FIG. 1 is adapted for engagement with lower tubular 16, but may also be adapted for engagement with another downhole tool positioned beneath the float collar. In other embodiments, a rounded piece may be provided at the lower end of the float collar, and this tool is frequently referred to as a float shoe. The term "float collar" as used herein refers to equipment intended for closing off the flow port through a tubular string, and includes both a conventional float collar and a float shoe. In a typical application, the float collar 10 controls the flow of fluidic materials from the lower end of the tubular string in the well. In other applications, the float collar may be used to control the flow of other fluidic materials out through the lower end of a tubular string.

The float collar 10 includes a generally tubular housing 12 adapted for connection with the lower end of the tubular string, e.g., by threads or welded. A generally sleeve-shaped elongate elastomeric body 20 is positioned within the housing 12 and about an elongate rod 18, which has a centerline 22. For this embodiment, centerline 12 coincides with the centerline of the elastomer and the centerline of the housing 12. However, a centerline of the elastomeric body and/or the rod may be eccentric to housing 12 in other applications. As disclosed subsequently, the elastomeric body 20 is designed to swell when subjected to downhole wellhead fluids (either pumped from the surface or downhole produced fluids), and will then close off the annular flow passage 24 between the elastomer 20 and the housing 12.

Figure 7:
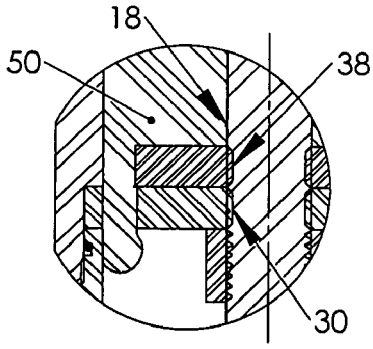
FIG. 7 is a detailed view showing expansion of the elastomer to fill the one or more ports in the plate.

FIG. 1 illustrates a lower plate 30 positioned below the elastomer, and an upper plate 32 at an upper end of the elastomer. Each of the lower plate and upper plate are supported on the elongate rod 18, and at least one of these plates is axially fixed relative to the tubular housing. For the embodiment shown in FIG. 1, the lower plate 30 is axially fixed relative to the housing 12 by being sandwiched between the upper pin end of the tubular 16 and a recess in the lower end of the housing 12. More particularly as shown in FIG. 7, the outer portion of plate 30 radially outward of the ports 34 (see FIG. 3) is secured in fixed engagement to the tubular housing 12. The axial spacing between the plates 30 and 32 may be controlled by threading of nuts 40 or 42, respectively, on the elongate rod 18. Another plate 38 is preferentially provided between the plate 30 and the lower end of the elastomer 20, and similarly a plate 48 is provided between the upper end of the elastomer 20 and the upper plate 32. Each of the plates 38 and 48 may be used to contain the ends of the elastomer during the manufacturing operation, and are then retained in engagement with the elastomer when the plates 30 and 32 are positioned as shown in FIG. 1. Plates 30 and 32 thus axially confine the elastomer during a swelling operation, thereby more reliably achieving an effective seal by radially expansion of the elastomer.

Figure 3:
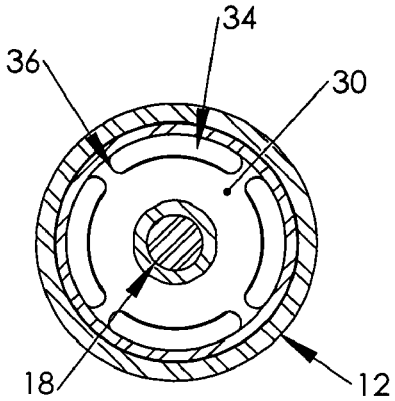
FIG. 3 is a cross-section through FIG. 1.

Referring now to FIG. 3, the plate 30 has a generally circular configuration with a center port for receiving the rod 18. A plurality of radially outward arcuate flow ports 34 are provided. The radially interior surface of each port 34 is generally aligned with the exterior surface of the elastomer 20, and the radially outward surface of each flow port 34 is generally aligned with the interior surface of the housing 12. A plurality of ribs 36 are thus provided, as shown in FIG. 3, with each rib being spaced between the ends of adjacent flow ports.

Figure 4:
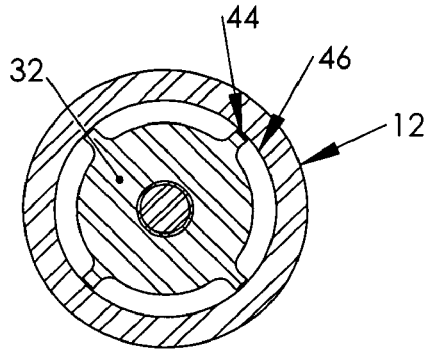
FIG. 4 is a cross-section through FIG. 1.

FIG. 4 illustrates a cross-section in the upper plate 32, which also has a generally circular configuration and a central port for receiving the threaded rod 18. The arcuate outer surfaces of the plate 32 may be generally aligned with the exterior surface of the elastomer 18. A plurality of ribs 44 project radially outward from the interior surface of the plate 32 and engage the interior of the housing 12, thereby aligning the upper end of the rod 18 and thus the elastomer 20 within the housing 12, and creating arcuate outer surface flow areas of the plate 32.

When the tool as shown in FIG. 1 is positioned downhole in a well, fluidic materials may reliably be pumped downward through the gaps 46 between the upper plate 32 and the housing 12, through the annulus 24 between the elastomer and the interior of the housing 12, and then through the ports 34 in the lower plate 30. In a typical application, cement which passes downward through the tool is pressurized to move upward in the annulus between the tool string and the borehole wall.

Figure 2:
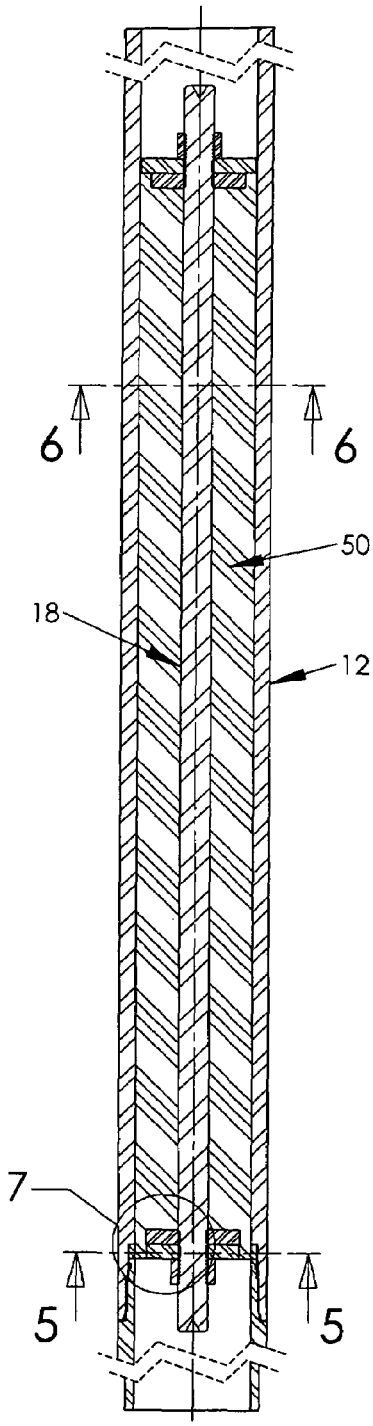
FIG. 2 illustrates the float collar as shown in FIG. 1 after swelling of the elastomer.
Figure 6:
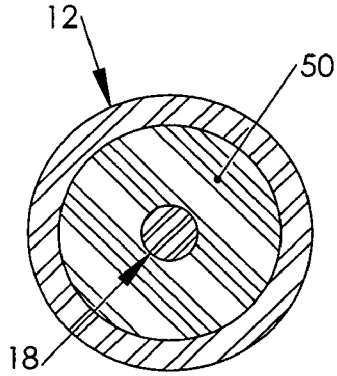
FIG. 6 is a cross-section through FIG. 2.

Referring now to FIG. 2, a float collar is shown with the elastomer 50 now in the swelled position. Various types of elastomers may be used for this purpose, including elastomers which are primarily intended to swell in response to water, and other elastomers which are primarily intended to swell in response to oil. FIG. 6 is a cross-section through a center section of the tool, which shows the elastomer 50 sealing with the ID of the housing 12 and with the OD of the rod 18. In most applications, the tool as shown in FIG. 2 would remain a permanent part of the well if cement were pumped through the tool since the cement would bond the outer housing 12 in place. If swellable casing packers, or other openhole anchoring devices were run, the housing 12 could be held permanently in place. If desired, components within the housing 12 may be removed during a drill-out operation. The lower plate 30 may be axially fixed relative to the housing 12 by being sandwiched between the upper pin end of the tubular 16 and a recess in the lower end of the housing 12, and holds the elastomer and metal end plates from rotating during a drilling operation. The upper plate may also be fixed in a similar manner. In other embodiments, each fixed plate may be axially secured to the housing by being snap fit or may be otherwise positioned in a receiving groove in the housing.

Figure 5:
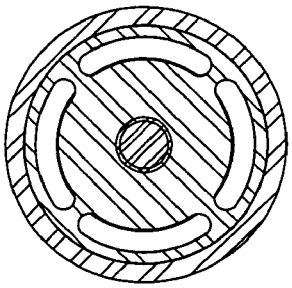
FIG. 5 is a cross-section through FIG. 2.

FIG. 5 shows the elastomer swelled radially outward, but the arcuate flow ports 34 as shown in FIG. 3 appear to remain as flow ports. FIG. 7 more accurately depicts the expansion of the elastomer 50 in a radial direction, which also leads to some expansion in an axial direction, i.e., downward past a lower end of the elastomer and upward past an upper end of the elastomer. As shown in FIG. 7, the elastomer 50 may thus expand to fill the gap between the housing 12 and the outer diameter of the end plate 38, and also the arcuate flow ports 34 in the lower plate 30. A significant advantage of allowing the elastomer to fill the flow ports 34 and flow points in plate 32 is that fluid pressure below the tool acts only on the cross-sectional area of the elastomer filling the flow ports 34 and flow points in plate 32, and this cross-section is relatively small compared to the cross-sectional area of the elastomer which otherwise would be responsive to high pressure. By reducing the pressure area of the elastomer exposed to high pressure fluid, the axial force of the pressure on the elastomer is significantly reduced.

The radially interior surface of the sleeve shaped elastomer is preferably in circumferential engagement with the elongate rod 18, and in a preferred embodiment this interior surface in the sleeve-shaped elastomer is bonded to the elongate rod. Additionally, the elastomeric body could be slid on and not bonded to the elongate rod. The pressure exposed plate preferably includes one or more circumferentially spaced arcuate flow ports, and in many applications two or more flow ports with radial ribs separate the flow ports. The interior surface of the flow ports may be substantially aligned in an exterior surface of the sleeve-shaped elastomer prior to swelling, and a radially exterior surface of each of the output flow ports may be substantially aligned with the interior surface of the tubular housing. This results is substantially uniform flow through the tool, with a relatively low pressure drop.

Although lower plate 30 as discussed herein is the plate which is subjected to high pressure fluid from beneath the tool, in other applications the pressure exposed plate could be the top plate 32, and in that case the arcuate flow ports as shown in FIG. 3 could be provided in the upper plate so that the structure of the upper and lower plates is effectively reversed.

The housing 12 is preferably a tubular housing adapted for connection with the lower end of a tubular string. In other embodiments, the interior surface of the housing may not be truly cylindrical, and the outer surface of the sleeve-shaped elastomer similarly may not have a circular cross-sectional configuration. Additionally, the interior surface of the housing 12 could include a series of axially spaced cylindrical grooves or one or more short spiral grooves that allow the sleeve-shaped elastomer to swell into the grooves to give an increased pressure differential capability. It is important, however, that the structure of the elastomer be configured with sealing engagement with the interior engagement of the housing when the elastomer swells.

Each of the lower plate 30 and the upper plate 32 may conveniently be a metal or composite material plate having a sufficient axial thickness for structural integrity. Each of the upper plate and the lower plate could have an axial thickness less than or greater than that shown in the figures. When referring to the lower and upper plate, the term "plate" means any geometric structure which acts as a substantially continuous barrier to axial migration of the elastomer during swelling, and which includes the flow ports as described herein. The pressure exposed plate includes one or more circumferentially spaced arcuate flow ports, and may include two or more such ports, with a radially extending rib between circumferential ends of adjacent flow ports. The pressure exposed plate may also have a radially outward portion for fixing the plate to the housing, as discussed above, although the radially outward portion of the pressure exposed plate may be eliminated if the other plate fixedly secures the rod and thus the subassembly within the housing.

According to the method of the invention, the flow of cement from the lower end of the tubular string is controlled by providing the housing, an elastomer, a lower plate and an upper plate as disclosed herein. Each of the upper plate and lower plate is preferably supported on the elongate rod, and at least one of the lower plate and upper plate is axially fixed relative to the housing. The plate intended for exposure to fluid pressure is provided with a plurality of arcuate flow ports for fluid communication with an annulus between the tubular housing and the sleeve-shaped elastomer. These flow ports are axially adjacent the elastomer to substantially fill the one or more flow ports when the elastomer swells to engage the tubular housing, thereby reducing the cross-sectional area of the elastomer exposed to fluid pressure.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A float collar for controlling flow of fluidic materials from a lower end of a tubular string in a well, comprising:

a housing adapted for a connection with the lower end of the tubular string;

a generally sleeve-shaped elastomer positioned about an elongate rod radially within the elastomer;

a lower plate at a lower end of the elastomer;

an upper plate at an upper end of the elastomer;

each of the lower plate and the upper plate supported on the elongate rod, at least one of the lower plate and the upper plate being axially fixed relative to the housing; and one of the lower plate and the upper plate for exposure to fluid pressure having a plurality of arcuate flow ports in fluid communication with an annulus between the housing and the sleeve-shaped elastomer.

2. The float collar as defined in claim 1, wherein a radially interior surface of this sleeve-shaped elastomer is in circumferential engagement with the elongate rod.

3. The float collar as defined in claim 2, wherein the radially interior surface of the sleeve shaped elastomeric is bonded to the elongate rod.

4. The float collar as defined in claim 1, wherein the pressure exposed plate includes two or more circumferentially spaced arcuate flow ports, with a radially extending rib between circumferential ends of adjacent flow ports.

5. The float collar as defined in claim 1, wherein the arcuate flow ports are axially adjacent the elastomer to substantially fill the one or more ports when the elastomer swells in response to downhole fluids, thereby reducing the cross-sectional area of the elastomer exposed to fluid pressure.

6. The float collar as defined in claim 1, wherein a radially interior surface of each flow port is substantially aligned with an exterior surface of the sleeve-shaped elastomer prior to the elastomer swelling in response to downhole fluids.

7. The float collar as defined in claim 1, wherein a radially exterior surface of each of the arcuate-shaped flow port is substantially aligned with an interior surface of the housing.

8. The float collar as defined in claim 1, further comprising:

one of more adjustment members for engaging the rod to adjust the axial spacing between the lower plate and the upper plate.

9. The float collar as defined in claim 1, wherein the lower plate is axially secured to the housing and includes the plurality of arcuate flow ports for exposure to fluid pressure below the float collar.

10. The float collar as defined in claim 1, wherein the other of the lower plate and the upper plate includes a plurality of radially extending ribs for engagement with the tubular housing, thereby forming another plurality of circumferential flow ports between adjacent ribs.

11. A float collar for controlling flow of fluidic materials from a lower end of a tubular string in a well, comprising:

a housing adapted for a connection with the lower end of the tubular string;

a generally sleeve-shaped elastomer positioned about an elongate rod radially within the elastomer, a radially interior surface of this sleeve-shaped elastomer being in circumferential engagement with the elongate rod;

a lower plate at a lower end of the elastomer;

an upper plate at an upper end of the elastomer;

each of the lower plate and the upper plate supported on the elongate rod for axially confining the elastomer during swelling of the elastomer in response to downhole fluids, at least one of the lower plate and the upper plate being axially fixed relative to the housing; and one of the lower plate and the upper plate for exposure to fluid pressure and having a plurality of flow ports in fluid communication with an annulus between the housing and the sleeve-shaped elastomer, the pressure exposed plate including a radially extending rib between circumferential ends of adjacent flow ports;

the flow ports being axially adjacent the elastomer to substantially fill the plurality of ports when the elastomer swells in response to downhole fluids, thereby reducing the cross-sectional area of the elastomer exposed to fluid pressure.

12. The float collar as defined in claim 11, wherein the radially interior surface of the sleeve shaped elastomeric is bonded to the elongate rod.

13. The float collar as defined in claim 11, wherein a radially interior surface of each flow port is substantially aligned with an exterior surface of the sleeve-shaped elastomer prior to swelling; and a radially exterior surface of each of the flow ports is substantially aligned with a interior surface of the housing.

14. The float collar as defined in claim 11, further comprising:

an outer portion of the pressure exposed plate radially outward of each of the one or more flow ports is in fixed engagement with the housing.

15. The float collar as defined in claim 12, wherein the other of the lower plate and the upper plate includes a plurality of radially extending ribs for engagement with the tubular housing, thereby forming another plurality of circumferential flow ports between adjacent ribs.

16. A method of controlling flow of fluidic materials from a lower end of a tubular string in a well, comprising:

providing a housing adapted for a connection with the lower end of the tubular string;

positioning a generally sleeve-shaped elastomer about an elongate rod radially within the elastomer;

providing a lower plate at a lower end of the elastomer;

providing an upper plate at an upper end of the elastomer;

supporting each of the lower plate and the upper plate on the elongate rod, at least one of the lower plate and the upper plate being axially fixed relative to the housing; and providing one of the lower plate and the upper plate for exposure to fluid pressure with one or more flow ports in fluid communication with an annulus between the tubular housing and the sleeve-shaped elastomer.

17. The method as defined in claim 16, wherein the flow ports are positioned axially adjacent the elastomer to substantially fill the one or more flow ports when the elastomer swells in response to downhole fluids, thereby reducing the cross-sectional area of the elastomer exposed to fluid pressure.

18. The method as defined in claim 16, wherein a radially interior surface of this sleeve-shaped elastomer is in circumferential engagement with and bonded to the elongate rod.

19. The method as defined in claim 16, wherein a radially interior surface of each flow port is substantially aligned with an exterior surface of the sleeve-shaped elastomer prior to swelling of the elastomer in response to downhole fluids.

20. The float collar as defined in claim 16, wherein a radially exterior surface of each of the flow ports is substantially aligned with a interior surface of the tubular housing.

21. The method as defined in claim 16, wherein the other of the lower plate and the upper plate includes a plurality of radially extending ribs for engagement with the tubular housing, thereby forming another plurality of circumferential flow ports between adjacent ribs.

* * * * *